US008302548B2

(12) United States Patent
Asao et al.

(10) Patent No.: US 8,302,548 B2
(45) Date of Patent: Nov. 6, 2012

(54) SEWING MACHINE

(75) Inventors: Hideo Asao, Chofu (JP); Nobuhiro Nishi, Chofu (JP)

(73) Assignees: Midori Anzen Co., Ltd., Shibuya-Ku, Tokyo (JP); Midori Anzen Hougi Co., Ltd., Chofu-Shi, Tokyo (JP)

( * ) Notice: Subject to any disclaimer, the term of this patent is extended or adjusted under 35 U.S.C. 154(b) by 0 days.

(21) Appl. No.: 12/996,151

(22) PCT Filed: Apr. 24, 2009

(86) PCT No.: PCT/JP2009/058158

§ 371 (c)(1),
(2), (4) Date: Dec. 3, 2010

(87) PCT Pub. No.: WO2009/147912

PCT Pub. Date: Dec. 10, 2009

(65) Prior Publication Data

US 2011/0083596 A1 Apr. 14, 2011

(30) Foreign Application Priority Data

Jun. 6, 2008 (JP) ..... 2008-149647

(51) Int. Cl.
*D05B 27/00* (2006.01)

(52) U.S. Cl. ..... 112/309

(58) Field of Classification Search ..... 112/443, 112/309, 156, 455, 189, 98, 198, 311, 312, 112/316–318, 228, 248, 289, 20, 28, 114
See application file for complete search history.

(56) References Cited

U.S. PATENT DOCUMENTS 1,849,333 A 3/1932 Myers
2,189,045 A 2/1940 Prazak
2,690,723 A 10/1954 Sudo (Continued)

FOREIGN PATENT DOCUMENTS

JP 28-003533 B 7/1953

(Continued)

OTHER PUBLICATIONS

Notification of Transmittal of Translation of the International Preliminary Report on Patentability (Forms PCT/IB/338 and PCT/IB/373) and the Written Opinion of the International Searching Authority (Forms PCT/ISA/237) issued in corresponding International Application No. PCT/JP2009/058158 dated Jan. 20, 2011.

(Continued)

*Primary Examiner* — Tejash Patel
(74) *Attorney, Agent, or Firm* — Buchanan Ingersoll & Rooney PC

(57) ABSTRACT

The present invention provides a sewing machine that can perform zigzag sewing a cylindrical sewn article.
A sewing machine 1 includes an approximately cylindrical guide member 11 that guides a sewn article A, a sewing needle 99 that sews the cylindrical sewn article A, a holding member 71 that holds the sewing needle 99 approximately vertically, a vertical hook 21 provided in the guide member 11 so that the direction of rotation is approximately perpendicular to the axial direction C of the guide member 11 and that catches the upper thread loop of the sewing needle 99, a rotary shaft 22 that rotates the vertical hook 21, and an operating means 50 that moves the holding member 71 and the rotary shaft 22 reciprocatingly at approximately the same time.

3 Claims, 12 Drawing Sheets

U.S. PATENT DOCUMENTS

| | | | | |
|---|---|---|---|---|
| 3,020,865 | A | 2/1962 | Forster et al. | |
| 3,033,139 | A | 5/1962 | Takeishi | |
| 4,241,681 | A | 12/1980 | Porter | |
| 4,289,083 | A | 9/1981 | Ciucani | |
| 4,467,733 | A * | 8/1984 | Martin | 112/2 |
| 4,665,848 | A * | 5/1987 | Michaels et al. | 112/305 |
| 4,730,566 | A * | 3/1988 | Brophy et al. | 112/470.07 |
| 5,154,590 | A | 10/1992 | Klein | |
| 2,709,978 | A | 6/1995 | Adler | |
| 5,458,073 | A | 10/1995 | Harada et al. | |
| 5,743,198 | A * | 4/1998 | Yamanaka et al. | 112/63 |
| 6,401,641 | B1 * | 6/2002 | Miyano | 112/470.05 |

FOREIGN PATENT DOCUMENTS

| | | | |
|---|---|---|---|
| JP | 30-007784 | B | 10/1955 |
| JP | 31-000791 | B | 2/1956 |
| JP | 43-015068 | Y | 6/1968 |
| JP | 44-008711 | B | 4/1969 |
| JP | 55-108387 | A | 8/1980 |
| JP | 3-141985 | A | 6/1991 |
| JP | 6-025269 | Y2 | 7/1994 |
| JP | 7-051476 | A | 2/1995 |
| JP | 7-028976 | B | 4/1995 |
| JP | 2839772 | B2 | 12/1998 |
| JP | 2000-084272 | A | 3/2000 |

OTHER PUBLICATIONS

International Search Report (PCT/ISA/210) for PCT/JP2009/058158 dated May 26, 2009.

* cited by examiner

SEWING MACHINE

TECHNICAL FIELD

The present invention relates to a sewing machine that fits a cylindrical sewn article around an approximately cylindrical guide member and rotatably sews the sewn article, the sewing machine performing lockstitching or zigzag sewing by moving a sewing needle reciprocatingly.

BACKGROUND ART

Conventionally, a sewing machine that performs zigzag sewing has a needle bar that holds a sewing needle having an upper end axially attached to a sewing machine body and attached so as to be oscillatable like a pendulum, a vertical hook provided so that the direction of rotation is approximately parallel with the sewing direction and that has a point that catches the thread loop of the sewing needle, a rotary shaft that rotates the vertical hook, and an operating means that moves the sewing needle and the vertical hook reciprocatingly at the same time (for instance, see Patent Documents 1 to 4).

In addition, another sewing machine that performs zigzag sewing has a needle bar that holds a sewing needle having an upper end axially attached to a sewing machine body and attached so as to be oscillatable like a pendulum, a vertical hook provided so that the direction of rotation is approximately perpendicular to the sewing direction and that has a point that catches the thread loop of the sewing needle, and a rotary shaft that rotates the vertical hook (for instance, see Patent Document 5).

Further, a still another sewing machine that performs zigzag sewing has a needle bar that holds a sewing needle having an upper end axially attached to a sewing machine body and attached so as to be oscillatable like a pendulum in the direction approximately parallel with the sewing direction, a vertical hook provided so that the direction of rotation is approximately parallel with the sewing direction and that has a point that catches the thread loop of the sewing needle, and a rotary shaft that rotates the vertical hook (for instance, see Patent Document 6).

Patent Document 1: Japanese Patent Application Publication (JP-B) No. 28-3533

Patent Document 2: Japanese Patent Application Publication (JP-B) No. 30-7784

Patent Document 3: Japanese Patent Application Publication (JP-B) No. 31-791

Patent Document 4: Japanese Utility Model Application Publication (JP-Y) No. 43-15068

Patent Document 5: Japanese Patent Application Publication (JP-B) No. 44-8711

Patent Document 6: Japanese Patent Application Publication (JP-B) No. 7-28976

DISCLOSURE OF THE INVENTION

Problems to be Solved by the Invention

In the conventional sewing machines that perform zigzag sewing, because the sewing needle sews the sewn article while being oscillated like a pendulum, the sewing needle diagonally penetrates through the sewn article. In the case of a sewing material such as a thin cloth, sewing can be smoothly performed, but in the case of a thick sewing material such as leather, the sewing needle is bent and it is hard for the needle to penetrate therethrough, and therefore, sewing cannot be smoothly performed. In addition, when the vertical hook is moved to the sewing machine body side, the sewing needle diagonally penetrates through the sewn article so that an end thereof gets close to the vertical hook. Conversely, when the vertical hook is moved away from the sewing machine body, the sewing needle penetrates through the sewn article so that the end is moved away from the vertical hook. When the sewing needle diagonally penetrates through the sewn article so that the end gets close to the vertical hook, the end can be abutted onto the vertical hook and be damaged. In addition, when the sewing needle penetrates through the sewn article so that the end is moved away from the vertical hook, the point of the vertical hook cannot catch the thread loop formed by the sewing needle. In this way, in the conventional sewing machines that perform zigzag sewing, there is the problem that sewing cannot be smoothly performed because the sewing needle is oscillated like a pendulum. In addition, in the case of the vertical hook adopted for the conventional sewing machines, the vertical hook being provided so that the direction of rotation is approximately parallel with the sewing direction, and having the point that catches the thread loop of the sewing needle, its mechanism is complicated and large in size. Accordingly, there is a mechanical limit on the reduction of the outside diameter (diameter). Therefore, the conventional sewing machines have a guide member that guides a large-diameter cylindrical sewn article such as a trouser leg portion, but does not have a guide member that guides a cylindrical sewn article having a small diameter of, e.g., approximately 3 cm. Further, there are no sewing machines that have a configuration in which the small-diameter cylindrical sewn article is fitted around a small-diameter cylindrical guide member to perform lockstitching such as zigzag sewing on the small-diameter cylindrical sewn article. For this reason, sewing in the circumferential direction of the small-diameter cylindrical sewn article has been performed only manually.

The present invention has been contrived in view of the above problems and an object of the present invention is to provide a sewing machine that can perform zigzag sewing on a small-diameter cylindrical sewn article, moves a sewing needle reciprocatingly and approximately vertically so that even a thick sewing material can be smoothly sewn, and enables the point of a vertical hook to reliably catch a thread loop.

Means for Solving the Problem

To achieve the above object, a sewing machine that sews a cylindrical sewn article has an approximately cylindrical guide member that guides the sewn article, a sewing needle that sews the cylindrical sewn article guided by the guide member, a holding member that holds the sewing needle approximately vertically, a vertical hook provided in the guide member so that the direction of rotation is approximately perpendicular to the axial direction of the guide member and that catches the upper thread loop of the sewing needle, a rotary shaft that rotates the vertical hook, and an operating means that moves the holding member and the rotary shaft reciprocatingly at approximately the same time in the axial direction of the rotary shaft.

To achieve the above object, in a sewing machine a feeding means that feeds the sewn article in a reverse sewing direction is provided to the guide member.

Effect of the Invention

In the sewing machine according to the present invention, when the cylindrical sewn article is fitted around the approximately cylindrical guide member for driving, the operating means moves the rotary shaft of the vertical hook and the holding member that holds the sewing needle reciprocatingly. Accordingly, the sewing needle is moved reciprocatingly and approximately vertically in the axial direction of the guide member, and the vertical hook is also moved reciprocatingly in the axial direction of the guide member so that the direction of rotation is approximately perpendicular to the axial direction of the guide member, thereby enabling sewing to be performed on the cylindrical sewn article guided by the guide member. In this way, the sewing machine according to the present invention can perform zigzag sewing in the circumferential direction of the cylindrical sewn article.

In the sewing machine according to the present invention, unlike the conventional sewing machines, the sewing needle does not diagonally penetrate through the sewn article because the needle is moved reciprocatingly and approximately vertically, and even a thick sewing material can be smoothly sewn because the sewing needle penetrates through the sewn article approximately perpendicularly. In addition, in the sewing machine according to the present invention, because the sewing needle and the vertical hook are moved reciprocatingly in the same direction at approximately the same time, the end of the sewing needle does not get close to or is not moved away from the vertical hook, unlike the conventional sewing machines, and the positional relationship between the end of the sewing needle and the vertical hook is constant so that the point of the vertical hook can reliably catch the upper thread loop. Further, in the sewing machine according to the present invention, because the feeding means that feeds the sewn article in the reverse sewing direction is provided to the guide member, the sewn article can be smoothly rotated in the circumferential direction along the circumferential surface of the guide member, and accordingly the sewing operation can be simplified.

BEST MODE FOR CARRYING OUT THE INVENTION

Figure 1:
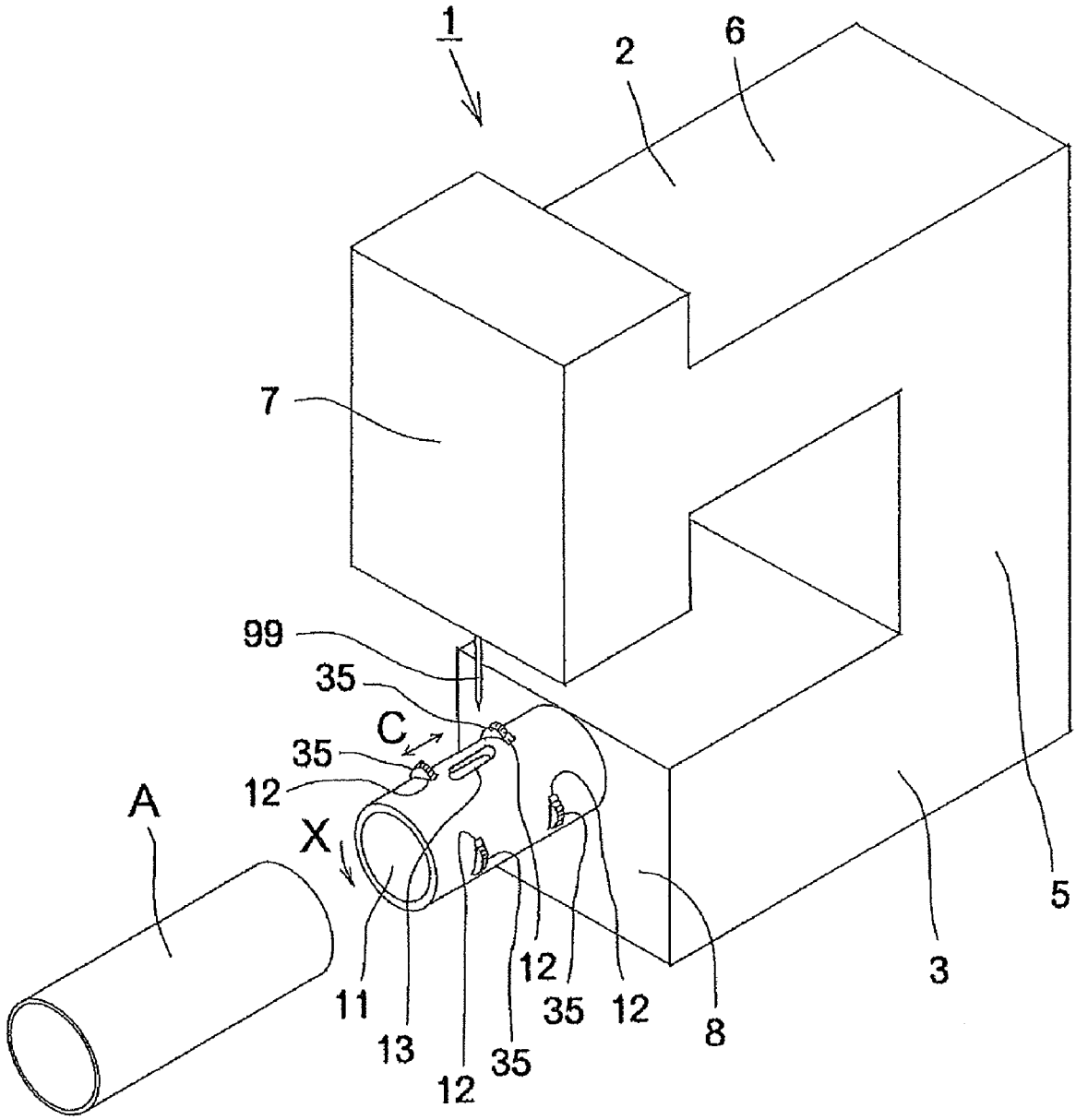
FIG. 1 is an overall perspective view showing an embodiment of a sewing machine according to the present invention.
Figure 2:
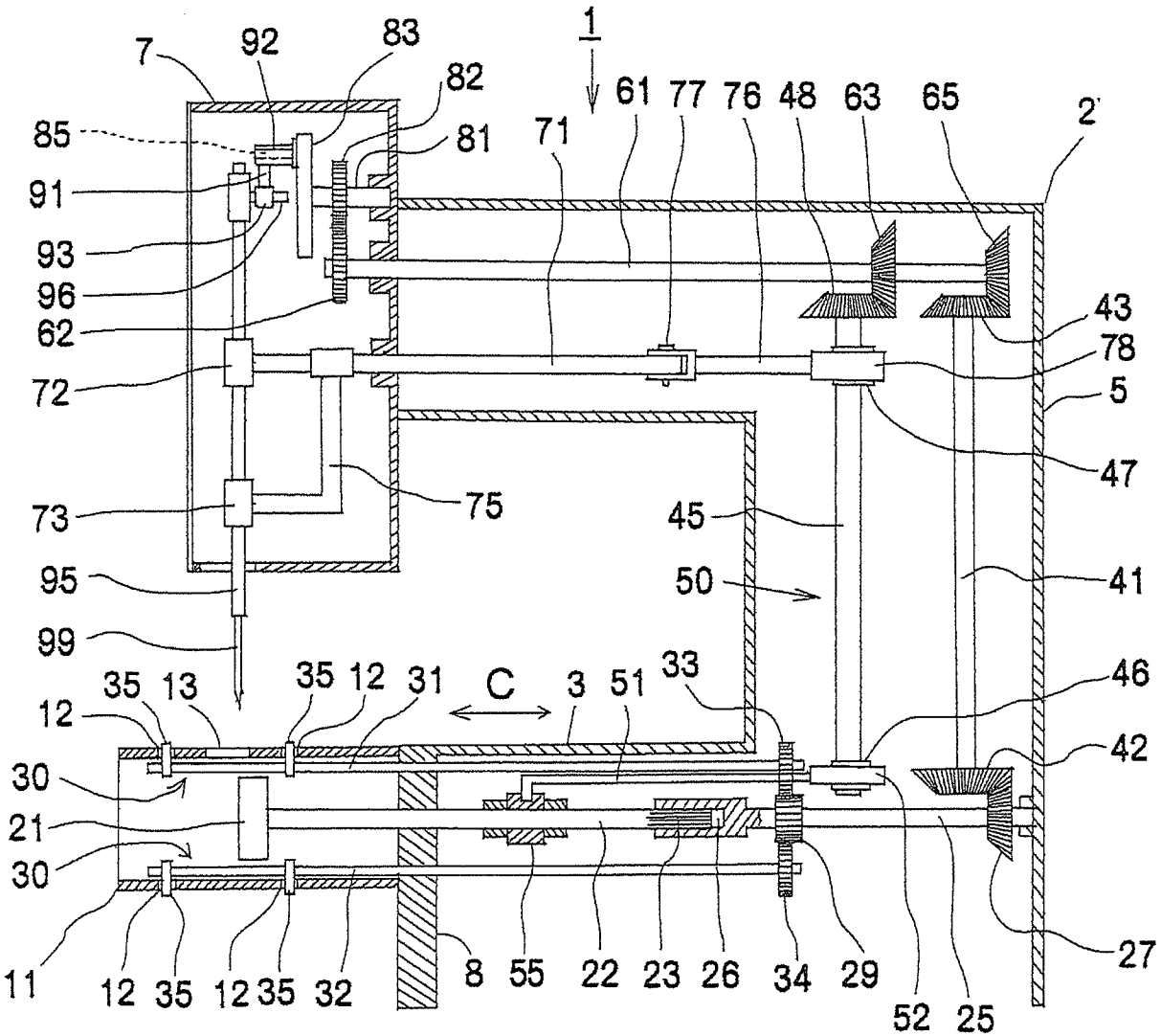
FIG. 2 is a side cross-sectional view of the sewing machine of FIG. 1.
Figure 3:
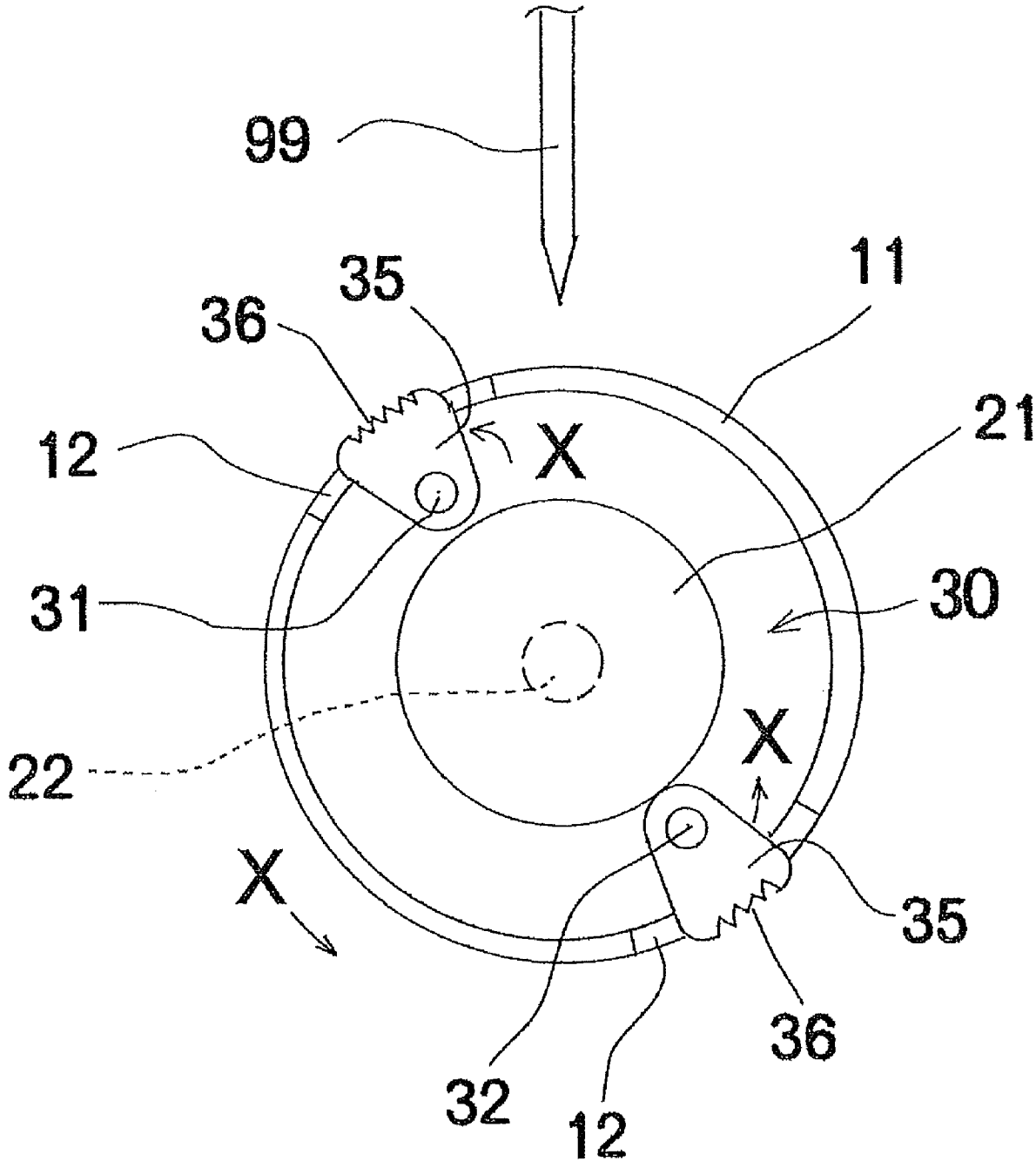
FIG. 3 is an explanatory view of assistance in explaining the sewn article feeding mechanism of the sewing machine of FIG. 1.
Figure 4:
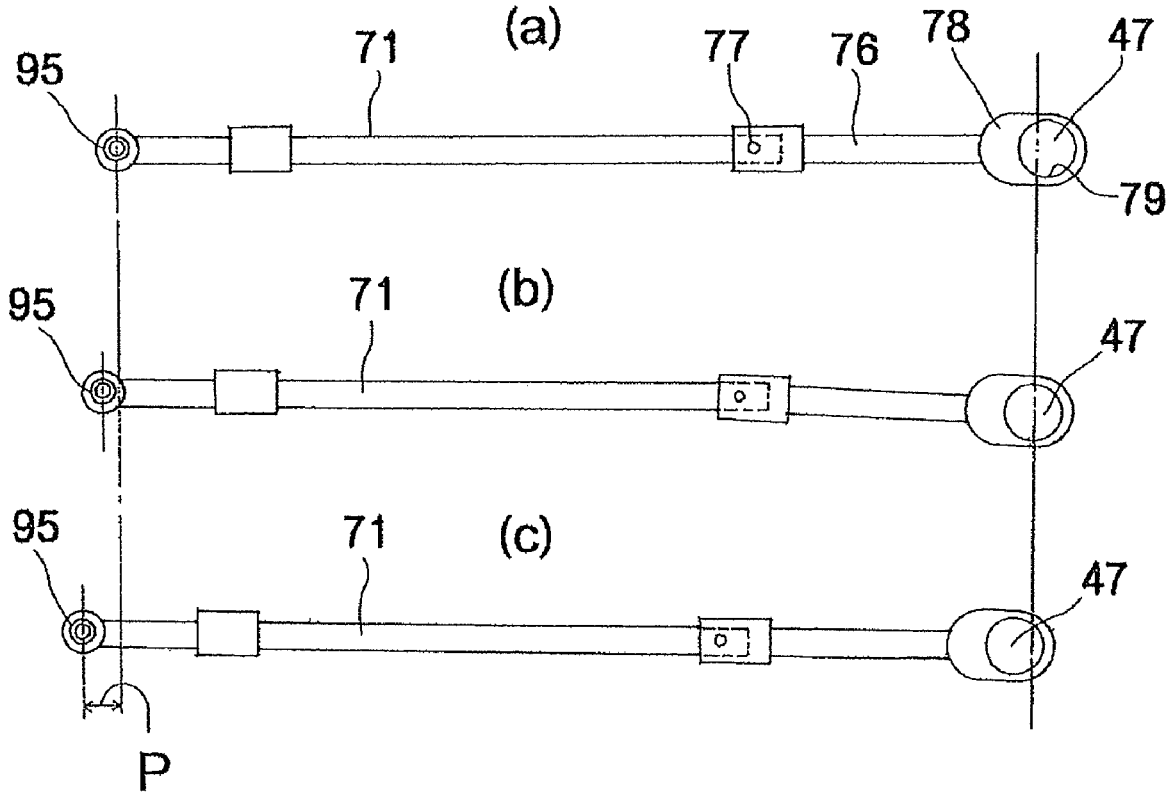
FIGS. 4(*a*), 4(*b*), and 4(*c*) are explanatory views of assistance in explaining the reciprocative movement operation of a sewing needle.
Figure 5:
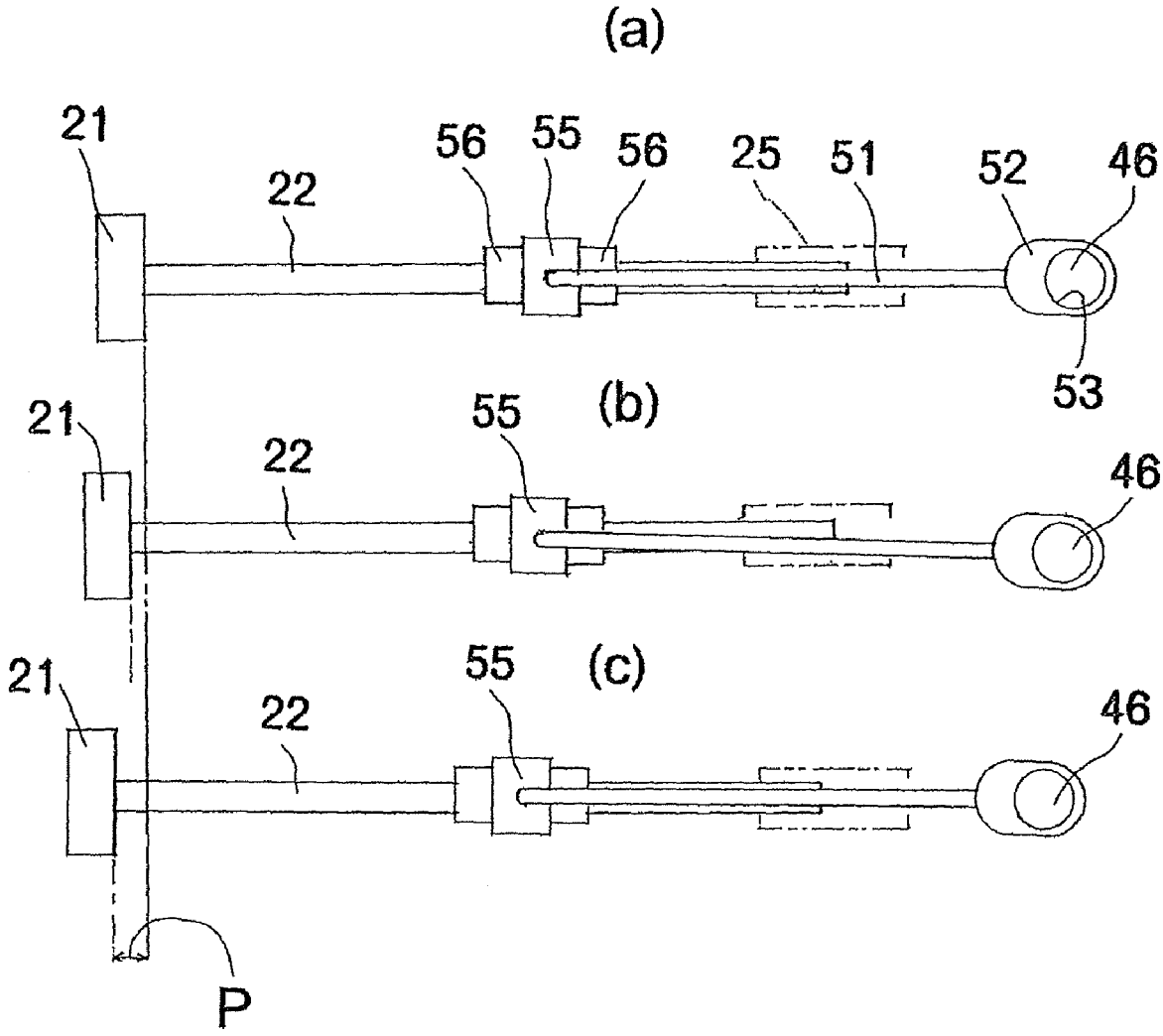
FIGS. 5(*a*), 5(*b*), and 5(*c*) are explanatory views of assistance explaining the reciprocative movement operation of a vertical hook.
Figure 6:
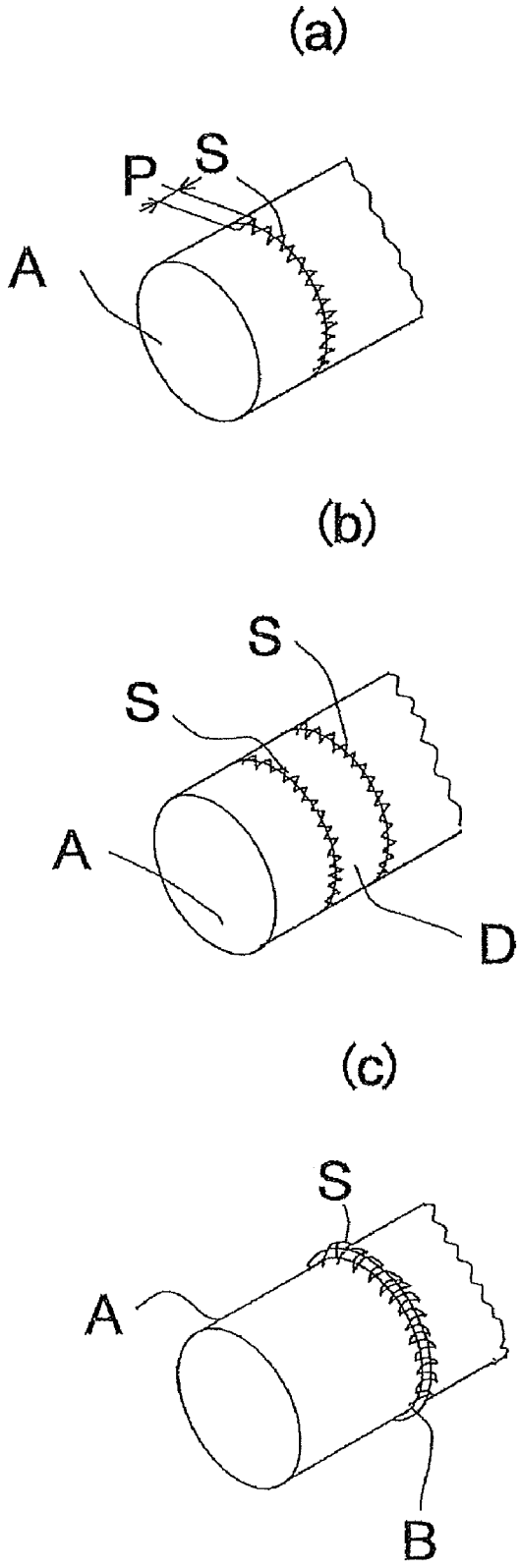
FIGS. 6(*a*), 6(*b*), and 6(*c*) are explanatory views of a sewn article.

An embodiment of a sewing machine according to the present invention will be described with reference to FIGS. 1 to 6. FIG. 1 is an overall perspective view of the sewing machine. FIG. 2 is a side cross-sectional view of the sewing machine. FIG. 3 is an explanatory view of assistance in explaining a feeding mechanism for a sewn article. FIGS. 4(*a*), 4(*b*), and 4(*c*) are explanatory views of assistance in explaining the reciprocative movement operation of a sewing needle. FIGS. 5(*a*), 5(*b*), and 5(*c*) are explanatory views of assistance in explaining the reciprocative movement operation of a vertical hook. FIGS. 6(*a*), 6(*b*), and 6(*c*) are explanatory views of the sewn article.

A sewing machine 1 sews a cylindrical sewn article A, and has an approximately cylindrical guide member 11 that guides the sewn article A, a sewing needle 99 that sews the cylindrical sewn article A guided by the guide member 11, a holding member 71 that holds the sewing needle 99 approximately vertically, a vertical hook 21 provided in the guide member 11 so that the direction of rotation is approximately perpendicular to an axial direction C of the guide member 11 and that catches the thread loop of the sewing needle 99, a rotary shaft 22 that rotates the vertical hook 21, and an operating means 50 that moves the holding member 71 and the rotary shaft 22 reciprocatingly at approximately the same time in the axial direction C of the rotary shaft 22. The guide member 11 has a feeding means 30 that feeds the sewn article A in a reverse sewing direction X.

In the sewing machine 1, when the cylindrical sewn article A is fitted around the approximately cylindrical guide member 11 for driving, the feeding means 30 feeds the sewn article A fitted around the guide member 11 in the reverse sewing direction X. At the same time, the operating means 50 moves the rotary shaft 22 of the vertical hook 21 and the holding member 71 that holds the sewing needle 99 reciprocatingly. Accordingly, the sewing needle 99 is moved reciprocatingly and approximately vertically in the axial direction C of the guide member 11, and the vertical hook 21 is also moved reciprocatingly in the axial direction C of the guide member 11 so that the direction of rotation is approximately perpendicular to the axial direction C of the guide member 11, thereby enabling sewing to be performed on the cylindrical sewn article A guided by the guide member 11. In this way, the sewing machine 1 can perform zigzag sewing in the circumferential direction of the cylindrical sewn article A.

In the sewing machine 1, unlike the conventional sewing machines, the sewing needle 99 does not diagonally penetrate through the sewn article because the sewing needle 99 is moved reciprocatingly and approximately vertically, and even a thick sewing material can be smoothly sewn because the sewing needle penetrates through the sewn article A approximately perpendicularly. In addition, in the sewing machine 1, because the sewing needle 99 and the vertical hook 21 are moved reciprocatingly in the same direction at approximately the same time, the end of the sewing needle does not get close to or is not moved away from the vertical hook, unlike the conventional sewing machines, and the positional relationship between the end of the sewing needle 99 and the vertical hook 21 is constant so that the point of the vertical hook 21 can reliably catch the upper thread loop. Further, in the sewing machine 1, because the feeding means 30 that feeds the sewn article A in the reverse sewing direction X is provided to the guide member 11, the sewn article A can be smoothly rotated in the circumferential direction along the circumferential surface of the guide member 11, and accordingly the sewing operation can be simplified.

Further, the sewing machine 1 will be described in detail. As shown in FIG. 1, a sewing machine body 2 of the sewing machine 1 has a lower frame 3, a vertical frame 5 erected in the rear portion of the lower frame 3, an upper frame 6 provided approximately horizontally in the upper portion of the vertical frame 5, and a front frame 7 provided at the front end of the upper frame 6. The approximately cylindrical guide member 11 is provided on a front wall 8 of the lower frame 3.

As shown in FIG. 2, the rotary shaft 22 and a lower transmission shaft 25 are rotatably provided in the lower frame 3. The rotary shaft 22 has a front portion inserted through the front wall 8 of the lower frame 3 so as to be projected into the guide member 11, and a front end to which the vertical hook 21 is attached. In the vertical hook 21, the center of rotation and the axis of the guide member 11 substantially coincide with each other so that the direction of rotation and the axial direction C of the guide member 11 are approximately perpendicular to each other.

A spline shaft 23 is formed in the rear portion of the rotary shaft 22. The spline shaft 23 of the rotary shaft 22 is inserted into a spline hole 26 formed in the front portion of the lower transmission shaft 25 so as to be slidable in the axial direction, and is coupled to the lower transmission shaft 25. In other words, the rotary shaft 22 is movable in the axial direction with respect to the lower transmission shaft 25. The lower transmission shaft 25 has a rear portion to which a final bevel gear 27 is integrally attached.

As shown in FIG. 3, a first feed shaft 31 and a second feed shaft 32 are provided in the opposite positions with respect to the rotary shaft 22 in the guide member 11. Feeding sections 35 formed with feed dogs 36 are fixed and attached to each of the feed shafts 31 and 32. The feeding sections 35 are projected from and drawn into through holes 12 formed in the guide member 11 upon rotation. The first feed shaft 31 and the second feed shaft 32 have rear portions inserted through the front wall 8 so as to be projected into the lower frame 3 and to which gears 33 and 34 are attached, respectively. The pair of gears 33 and 34 engages a gear 29 fixed to the lower transmission shaft 25. The feed shafts 31 and 32 and the feeding sections 35 configure the feeding means 30 that feeds the sewn article A fitted around the guide member 11 in the reverse sewing direction X. A needle insertion hole 13 that inserts the sewing needle 99 therethrough is formed in the guide member 11. Because the sewing needle 99 is moved reciprocatingly in the axial direction C of the guide member 11, the needle insertion hole 13 is formed to be elongated in the axial direction C of the guide member 11.

A first power shaft 41 and a second power shaft 45 are rotatably provided in the vertical frame 5. The first power shaft 41 has a lower portion to which a first bevel gear 42 is integrally attached, and an upper portion to which a second bevel gear 43 is integrally attached. The first bevel gear 42 engages the final bevel gear 27 of the lower transmission shaft 25.

The second power shaft 45 has a lower portion to which a lower cam 46 is integrally attached, and an upper portion to which an upper cam 47 is integrally provided. As shown in FIGS. 5(*a*), 5(*b*), and 5(*c*), the lower cam 46 is fitted through a fitting hole 53 of a coupling body 52 provided in the rear portion of a coupling shaft 51. The front portion of the coupling shaft 51 is rotatably attached to a holding ring 55 that rotatably holds the rotary shaft 22. The holding ring 55 is gripped between a pair of fixing rings 56 and 56 fixed to the rotary shaft 22, and is restricted so as not to be moved on the rotary shaft 22 in the axial direction. The second power shaft 45 has an upper end to which a third bevel gear 48 is fixed.

A driving shaft 61 and the holding shaft 71 are provided in the upper frame 6. The driving shaft 61 has a front portion projected into the front frame 7, a front end to which a driving gear 62 is attached, a rear portion to which a fourth bevel gear 63 is attached, and a rear end to which a fifth bevel gear 65 is attached. The fourth bevel gear 63 engages the third bevel gear 48 of the second power shaft 45. The fifth bevel gear 65 engages the second bevel gear 43 of the first power shaft 41.

The holding shaft 71 has a front portion projected into the front frame 7, and a front end to which an upper holding pipe 72 that holds a needle bar 95 approximately vertically is attached. In addition, a lower holding pipe 73 is attached to the holding shaft 71 in the front frame 7 via an approximately L-shaped connecting member 75. The needle bar 95 is held approximately vertically by the upper holding pipe 72 and the lower holding pipe 73, and the needle bar 95 is movable vertically. The holding shaft 71 has a rear portion to which a coupling shaft 76 is attached via a center shaft 77. As shown in FIGS. 4(*a*), 4(*b*), and 4(*c*), the upper cam 47 is fitted through a fitting hole 79 of a coupling body 78 provided in the rear portion of the coupling shaft 76. The second power shaft 45 and the coupling shafts 51 and 76 configure the operating means 50 that moves the holding member 71 and the rotary shaft 22 reciprocatingly at approximately the same time in the axial direction of the rotary shaft 22.

A driven shaft 81 is rotatably provided in the front frame 7. The driven shaft 81 has an approximately middle portion provided with a driven gear 82 that engages the driving gear 62, and an end to which a rotor 83 is fixed. An eccentric pin 85 is provided on the rotor 83 so as to be eccentric from the center of rotation. One end of a crank arm 91 is rotatably attached to the eccentric pin 85, and the other end thereof is rotatably attached to the upper end of the needle bar 95. In other words, the crank arm 91 has both ends formed with bearing bosses 92 and 93. The bearing boss 92 at the one end of the crank arm 91 is attached so as to be rotatable with respect to the eccentric pin 85 of the rotor 83 and to be movable in the axial direction of the eccentric pin 85. The bearing boss 93 at the other end of the crank arm 91 is attached so as to be rotatable with respect to a pin 96 formed in the upper portion of the needle bar 95 and to be movable in the axial direction of the pin 96. The sewing needle 99 is detachably attached to the end of the needle bar 95.

The sewing machine 1 has the above configuration, and fits the cylindrical sewn article A around the cylindrical guide member 11 for driving. The first power shaft 41 or the second power shaft 45 is driven by a motor, which is not shown. For instance, when the first power shaft 41 is driven, the driving shaft 61 is rotated via the second bevel gear 43 and the fifth bevel gear 65. When the driving shaft 61 is rotated, the eccentric pin 85 is rotated via the driving gear 62, the driven gear 82, the driven shaft 81, and the rotor 83 to operate the crank arm 91. When the crank arm 91 is operated, the needle bar 65 is moved reciprocatingly and approximately vertically via the pin 96 so that the sewing needle 99 sews the sewn article A.

In addition, the power of the first power shaft 41 is transmitted to the lower transmission shaft 25 via the first bevel gear 42 and the final bevel gear 27 to rotate the lower transmission shaft 25. When the lower rotational shaft 25 is rotated, the vertical hook 21 is rotated via the spline hole 26, the spline shaft 23, and the rotary shaft 22. By the rotation of the vertical hook 21, its point catches the thread of the sewing needle 99 to perform lockstitching. In addition, the rotation of the lower transmission shaft 25 is transmitted to the gear 29, the gear 33, and the first feed shaft 31 to rotate the feeding sections 35 in the reverse sewing direction X. Likewise, the rotation of the lower transmission shaft 25 is transmitted to the gear 29, the gear 34, and the second feed shaft 32 to rotate the feeding sections 35 in the reverse sewing direction X. The feeding sections 35 are rotated while being projected from and drawn into the through hole 12, and their feed dogs 36 . . . intermittently rotate the sewn article A in the reverse sewing direction X. Further, because the feeding sections 35 . . . are provided in the opposite positions in the guide member 11, the sewn article A can be uniformly fed without being flexed.

As described above, when the rotary shaft 61 is rotated, the second power shaft 45 is rotated via the fourth bevel gear 63 and the third bevel gear 48. As shown in FIGS. 5(*a*), 5(*b*), and 5(*c*), when the second power shaft 45 is rotated, the lower cam 46 is also rotated to move the rotary shaft 22 via the coupling body 52, the coupling shaft 51, and the holding ring 55 reciprocatingly in the axial direction. Because the vertical hook 21 is integrally attached to the front end of the rotary shaft 22, the vertical hook 21 is also moved reciprocatingly in the guide member 11. The width in which the vertical hook 21 is moved reciprocatingly is represented by P, and the width P is a sewing width. In addition, as shown in FIGS. 4(*a*), 4(*b*), and 4(*c*), when the second power shaft 45 is rotated, the upper cam 47 is also rotated to move the holding shaft 71 via the coupling body 78, the coupling shaft 76, and the center shaft 77 reciprocatingly in the axial direction. Because the needle bar 95 is held approximately vertically at the front end of the holding shaft 71, the needle bar 95 is also moved reciprocatingly while maintaining the approximately vertical state. The width in which the needle bar 95 is moved reciprocatingly is represented by P. In this way, because the needle bar 95 and the vertical hook 21 have the same reciprocative movement width P, when the second power shaft 45 is driven, the vertical hook 21 and the sewing needle 99 perform the reciprocative movement operation at the same time while holding the same distance.

In the sewing machine 1, while the feeding members 35 and 35 rotate the sewn article A fitted around the guide member 11 in the reverse sewing direction X, the sewing needle 99 is moved reciprocatingly to perform lockstitching and zigzag sewing S on the sewn article A at the sewing width P, as shown in FIGS. 6(*a*), 6(*b*), and 6(*c*). In the sewn article A shown in FIG. 6(*a*), the zigzag sewing S is performed on the folded bottom edge. In the sewn article A shown in FIG. 6(*b*), the zigzag sewing S is performed on both edges of another cylindrical small section D. In the sewn article A shown in FIG. 6(*c*), an annular member B such as a rubber band and a wire is fixed by the zigzag sewing S. In the sewing machine 1, the outside diameter of the guide member 11 can be reduced to approximately 3 cm or less, and the zigzag sewing S can be performed on the narrow cylindrical sewn article A, which cannot be performed by the conventional sewing machines.

Figure 7:
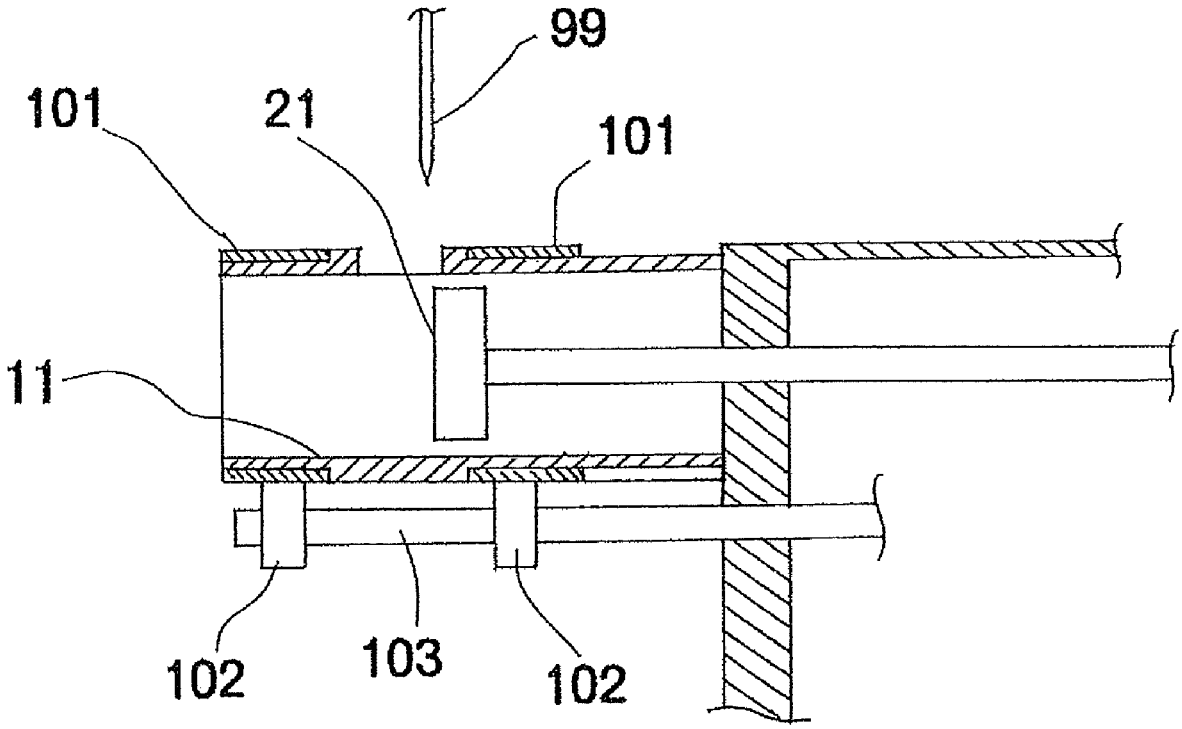
FIG. 7 is an explanatory view of assistance in explaining another embodiment of the feeding means.

In the above embodiment, the feeding means 30 is provided to the guide member 11 to intermittently feed the sewn article A in the reverse sewing direction X. However, as shown in FIG. 7, the sewn article A fitted around the guide member 11 may be rotated by driving rollers 102 and 102. Further, rotatable rotational tubes 101 and 101 may be provided on the circumferential surface of the guide member 11 so that the sewn article A is easily rotated. The surface of the rotational tube 101 and the surface of the driving roller 102 are desirably subjected to a knurling process so as not to slip the sewn article A. The sewn article A is provided immediately between the driving rollers 102 and 102 and the rotational tubes 101 and 101, and can be reliably rotated. Because the driving rollers 102 and 102 are attached to a rotary shaft 103 that is rotated by a servo motor, which is not shown, the intermittent rotation of the driving rollers 102 and 102 can also be operated so as to be interlocked with the sewing operation of the sewing needle 99.

Figure 10:
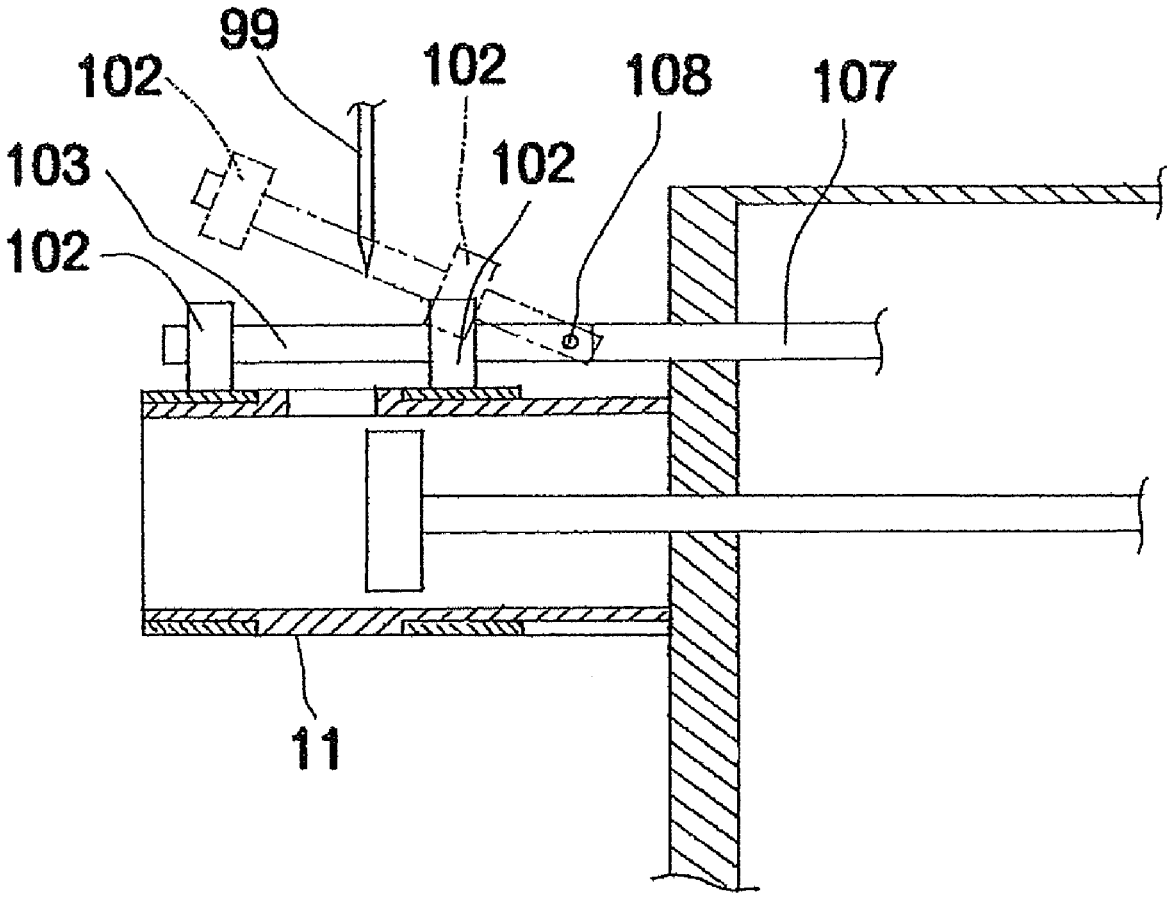
FIG. 10 is an explanatory view of assistance in explaining a further embodiment of the feeding meads.

In addition, as shown in FIG. 10, the driving rollers 102 and 102 can also be arranged in the positions where the sewn article A is pulled in the reverse sewing direction X near the sewing needle 99. The rotary shaft 103 to which the pair of driving rollers 102 and 102 are attached is oscillatably coupled to a motor shaft 107 rotated by the servo motor, which is not shown, via a holding shaft 108. A resilient member such as a spring, which is not shown, is provided in the coupling portion of the rotary shaft 103 and the motor shaft 107. The rotary shaft 103 is urged toward the guide member 11 side by the resilient member, and the driving rollers 102 and 102 are pressed onto the rotational tubes 101 and 101. Because the sewn article A is provided immediately between the driving rollers 102 and 102 and the rotational tubes 101 and 101, it is reliably rotated. The driving rollers 102 and 102 are forcibly rotated via the servo motor, not shown, the motor shaft 107, and the rotary shaft 103, and the intermittent rotation of the driving rollers 102 and 102 can be operated so as to be interlocked with the sewing operation of the sewing needle 99. When the driving rollers 102 and 102 oscillate the rotary shaft 103 against the resilience of the resilient member, the driving rollers 102 and 102 are moved away from the guide member 11. For this reason, the sewn article A can be easily and quickly fitted around the guide member 11 without contacting with the driving rollers 102 and 102. Although the rotary shaft 103 and the motor shaft 107 are coupled by the holding shaft 108, needless to say, they may be coupled by another coupling member such as a universal joint.

Figure 8:
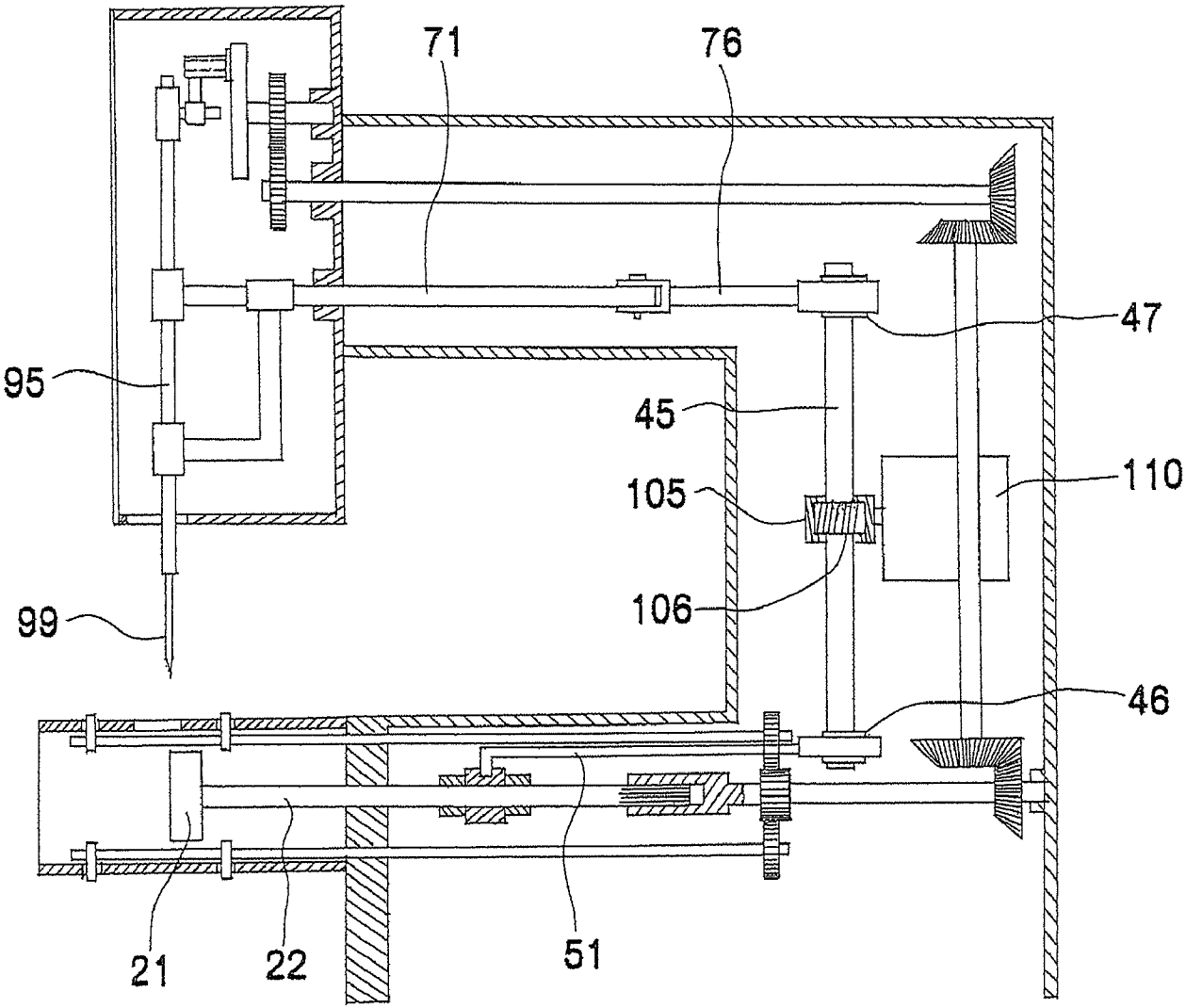
FIG. 8 is a side cross-sectional view of the sewing machine according to another embodiment.
Figure 9:
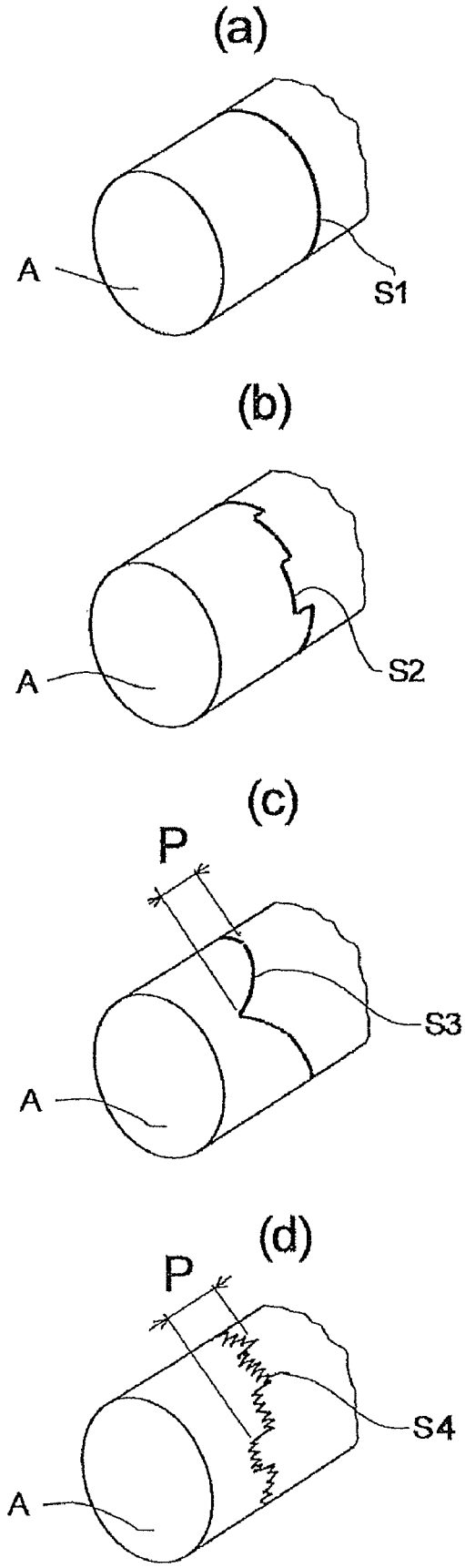
FIGS. 9(*a*), 9(*b*), 9(*c*), and 9(*d*) are explanatory views of the sewn article.

In the above embodiment, the first power shaft 41 and the second power shaft 45 are interlocked by the engagement of the fourth bevel gear 63 and the third bevel gear 48. However, as shown in FIG. 8, the second power shaft 45 may be coupled to a servo motor 110 via gears 105 and 106 to rotate the second power shaft 45 by the servo motor 110. Thus, when the servo motor 110 is not driven, as shown in FIG. 9(*a*), the sewing machine 1 can be operated as a sewing machine for straight line lockstitching S1. In addition, when the servo motor 110 is driven for an arbitrary time, as shown in FIG. 9(*b*), the sewing machine 1 can be operated as a sewing machine for stepwise lockstitching S2 in which the sewing position is shifted. Further, when the servo motor 110 is driven at low speed, as shown in FIG. 9(*c*), wavy pattern lockstitching S3 can be performed. Meanwhile, when the servo motor 110 is driven at high speed, zigzag sewing can be performed, as described above. The sewing width P of the zigzag sewing can be freely set by controlling the operation of the servo motor 110. Using such feature, as shown in FIG. 9(*d*), plural-zigzag sewing S4 including three zigzags, four zigzags, and so on can also be performed. These lockstitching operations are all performed on the cylindrical sewn article A.

Figure 11:
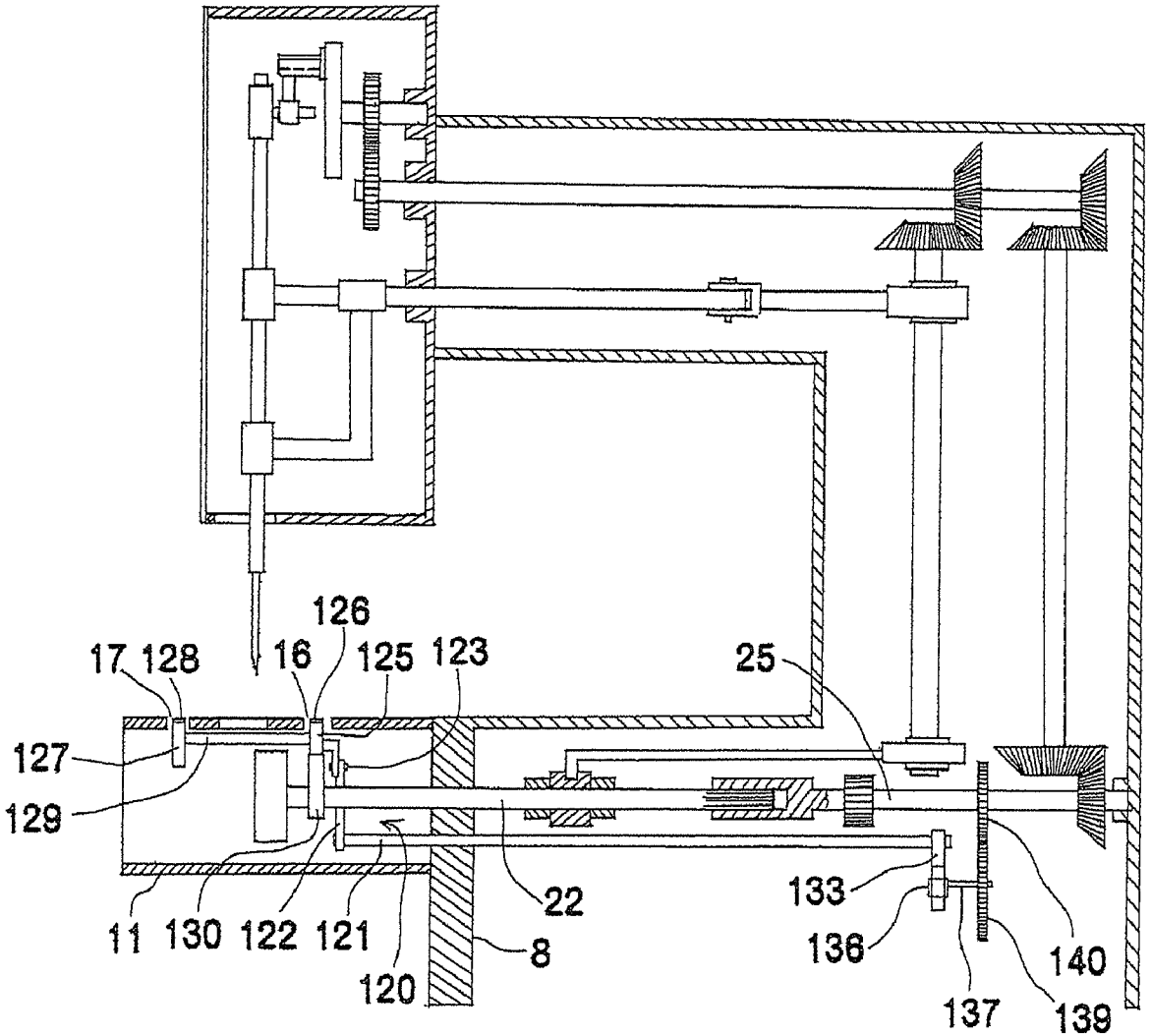
FIG. 11 is a side cross-sectional view of assistance in explaining a still another embodiment of the feeding means.
Figure 12:
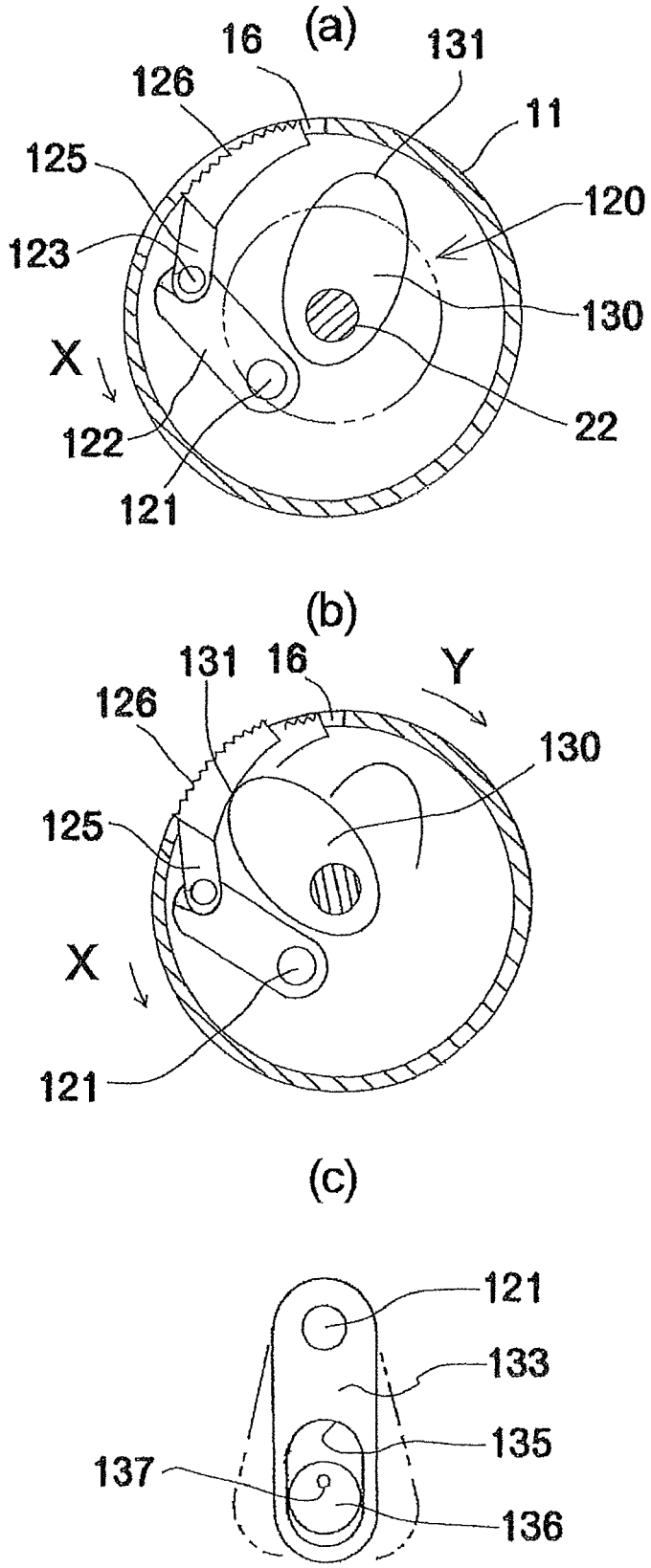
FIGS. 12(*a*), 12(*b*), and 12(*c*) are front cross-sectional views of assistance in explaining the feeding means of FIG. 11.

In the above embodiment, the rotating feeding sections 35 and 35 are provided as the feeding means 30 for the sewn article A, but as shown in FIGS. 11, 12(*a*), 12(*b*), and 12(*c*), an oscillating feeding section 125 may be provided as a feeding means 120 that feeds the sewn article A. An oscillating shaft 121 is provided below the rotary shaft 22 in the guide member 11. The base portion of an oscillating arm 122 is fixed and attached to the front portion of the oscillating shaft 121. The feeding section 125 is rotatably coupled to the end of the oscillating arm 122 via a holding shaft 123. A feed dog 126 is formed with respect to the feeding section 125. A resilient member such as a spring is provided in the coupling portion of the oscillating arm 122 and the feeding section 125, and the feed dog 126 of the feeding section 125 is urged in the center direction of the guide member 11 and can be projected from and drawn into a through hole 16 formed in the guide member 11.

A cam 130 is fixed to the rotary shaft 22. The cam 130 is rotated together with the rotary shaft 22. An end 131 is abutted onto the feeding section 125 to push the feeding section 125 towards the outside of the guide member 11 against the resilience of the resilient member, and the feed dog 126 is projected from the through hole 16 formed in the guide member 11. Another feeding section 127 is coupled to the feeding section 125 by a coupling section 129. The feeding section 127 also has a feed dog 128 like the feeding section 125, and is oscillated together with the feeding section 125 so that the feed dog 128 is projected from and drawn into another through hole 17 formed in the guide member 11.

The oscillating shaft 121 has a rear portion inserted through the front wall 8 so as to be projected into the lower frame 3 and to which an arm 133 is fixed and attached (see FIG. 12(*c*)). A slot 135 is formed in the arm 133 in a longitudinal direction. The slot 135 engages an eccentric cam 136. The eccentric cam 136 is fixed to one end of a shaft 137. A spur gear 139 is provided at the other end of the shaft 137. The spur gear 139 engages a spur gear 140 fixed to the lower transmission shaft 25. The oscillating shaft 121, the oscillating arm 122, the feeding section 125, and the cam 130 configure the feeding means 120 that feeds the sewn article A fitted around the guide member 11 in the reverse sewing direction X.

In the sewing machine 1, the rotation of the lower transmission shaft 25 is transmitted to the eccentric cam 136 via the spur gears 140 and 139 and the shaft 137 to rotate the eccentric cam 136, and the rotation of the eccentric cam 136 oscillates the arm 133 via the slot 135. When the arm 133 is oscillated, the feeding section 125 is oscillated along the circumferential direction via the oscillating shaft 121 and the oscillating arm 122. In addition, the rotary shaft 22 is also rotated, and the cam 130 fixed to the rotary shaft 22 is also rotated. As shown in FIG. 12(*b*), when the feeding section 125 is moved in the feeding direction X of the sewn article A, the end 131 of the cam 130 pushes up the feeding section 125 against the resilience of the resilient member to project the feed dog 126 from the through hole 16. When the feeding section 125 is moved in a reverse feeding direction Y of the sewn article A, the cam 130 is moved away from the feeding section 125 to enter into the guide member 11 by the resilience of the resilient member. In this way, the feeding section 125 is intermittently projected from and drawn into the guide member 11 to intermittently rotate the sewn article A in the reverse sewing direction X. Because the feeding section 127 is also operated so as to be interlocked with the feeding section 125, it intermittently rotates the sewn article A together with the feeding section 125 in the reverse sewing direction X.

INDUSTRIAL APPLICABILITY

The present invention is applicable to the sewing machine that sews a narrow cylindrical sewn article.

DESCRIPTION OF THE REFERENCE NUMERALS

A sewn article, B annular member, C axial direction, D cylindrical small section, P sewing width, S zigzag sewing, S1 straight line lockstitching, S2 stepwise lockstitching, S3 wavy pattern lockstitching, S4 plural-zigzag sewing, X reverse sewing direction (feeding direction), Y sewing direction (reverse feeding direction), 1 sewing machine, 2 sewing machine body, 3 lower frame, 5 vertical frame, 6 upper frame, 7 front frame, 8 front wall, 11 guide member, 12 through hole, 13 needle insertion hole, 14 through hole, 16 through hole, 17 through hole, 21 vertical hook, 22 rotary shaft, 23 spline shaft, 25 lower transmission shaft, 26 spline hole, 27 final bevel gear, 29 gear, 30 feeding means, first feed shaft, 32 second feed shaft, 33 gear, 34 gear, feeding section, 36 feed dog, 41 first power shaft, 42 first bevel gear, 43 second bevel gear, 45 second power shaft, lower cam, 47 upper cam, 48 third bevel gear, 50 operating means, 51 coupling shaft, 52 coupling body, 53 fitting hole, 55 holding ring, 56 fixing ring, 61 driving shaft, 62 driving gear, 63 fourth bevel gear, 65 fifth bevel gear, 71 holding shaft (holding member), 72 upper holding pipe, 73 lower holding pipe, 75 connecting member, 76 coupling shaft, 77 center shaft, 78 coupling body, 79 fitting hole, 81 driven shaft, 82 driven gear, 83 rotor, 85 eccentric pin, 91 crank arm, 92 bearing boss, 93 bearing boss, needle bar, 96 pin, 99 sewing needle, 101 rotational cylinder, 102 driving roller, 103 rotary shaft, 105 gear, 106 gear, 107 motor shaft, 108 holding shaft, 110 servo motor, 120 feeding means, 121 oscillating shaft, 122 oscillating arm, 123 holding shaft, 125 feeding section, 126 feed dog, 127 feeding section, 128 feed dog, 129 coupling section, 130 cam, 131 end, 133 arm, 135 slot, 136 eccentric cam, 137 shaft, 139 spur gear, 140 spur gear

The invention claimed is:

1. A sewing machine that sews a cylindrical sewn article, comprising:

an approximately cylindrical guide member that guides the sewn article;

a sewing needle that sews the cylindrical sewn article guided by the cylindrical guide member;

a holding member that holds the sewing needle approximately vertically;

a vertical hook provided in the cylindrical guide member so that a direction of rotation is approximately perpendicular to an axial direction of the cylindrical guide member and that catches a thread loop of the sewing needle;

a rotary shaft that rotates the vertical hook; and an operator for moving the holding member and the rotary shaft reciprocatingly at approximately the same time in the axial direction.

2. The sewing machine according to claim 1, comprising: a feeder for feeding the sewn article in a reverse sewing direction is provided to the cylindrical guide member.

3. A cylindrical sewn article made by the sewing machine according to claim 1.

* * * * *